United States Patent [19]

Sanchez

[11] 4,028,984

[45] June 14, 1977

[54] MUSICAL APPARATUS

[76] Inventor: Edward J. Sanchez, 727 Richland Ave., Baton Rouge, La. 70896

[22] Filed: May 3, 1976

[21] Appl. No.: 682,383

[52] U.S. Cl. ..... 84/422 R

[51] Int. Cl.[2] ..... G10D 13/00

[58] Field of Search ..... 84/422 R, 422 S

[56] References Cited

UNITED STATES PATENTS

| | | | |
|---|---|---|---|
| 1,360,031 | 11/1920 | Scheurer et al. | 84/422 R |
| 1,479,376 | 1/1924 | Danly | 84/422 R |
| 1,799,901 | 4/1931 | Hiers et al. | 84/422 R |

*Primary Examiner*—Lawrence R. Franklin
*Attorney, Agent, or Firm*—Roy, Kiesel, Patterson, Hudson & Abadie

[57] ABSTRACT

A foot operated apparatus for playing a cymbal, drum or similar band instrument having a striking stick flexibly pivotedly mounted and used to strike the cymbal, drum or similar band instrument.

1 Claim, 5 Drawing Figures

MUSICAL APPARATUS

BACKGROUND OF THE INVENTION

Field of the Invention.

This invention relates generally to musical instruments, and more specifically to foot operated apparatus for playing a cymbal, drum or similar instrument.

Prior Art.

The use of foot pedal devices for striking drums or cymbals is well known to present day musicians. However, none of these devices are capable of utilizing a flexibly pivoted stick to strike the musical instrument. Instead they use rigidly mounted sticks or beaters. Furthermore, none of the prior art devices can be used to simultaneously play two instruments, and particularly two different instruments.

Another difficulty with many of the prior art devices has been the noise generated by the device itself during use. Because this extraneous noise interferes with the music being played these devices have not been accepted by the musicians.

SUMMARY OF THE INVENTION

Therefore, one object of this invention is to provide a foot operated apparatus that may be used to play a cymbal, drum or similar instrument.

Another object is to provide a foot operated apparatus that is itself virtually noiseless during playing of a cymbal, drum or similar instrument.

A further object is to provide a foot operated apparatus that has means for dampening of the oscillatory action of the stick used to strike the cymbal, drum or similar instrument.

A still further object is to provide a foot operated apparatus for simultaneously playing two or more musical instruments such as cymbals or drums.

Accordingly, a foot operated apparatus for playing a cymbal, drum or similar instrument is provided having a striking stick flexibly pivotedly mounted on a rigid arm member attached to a foot pedal assembly that moves the arm member up and down.

PREFERRED EMBODIMENTS OF THE INVENTION

Figure 2:
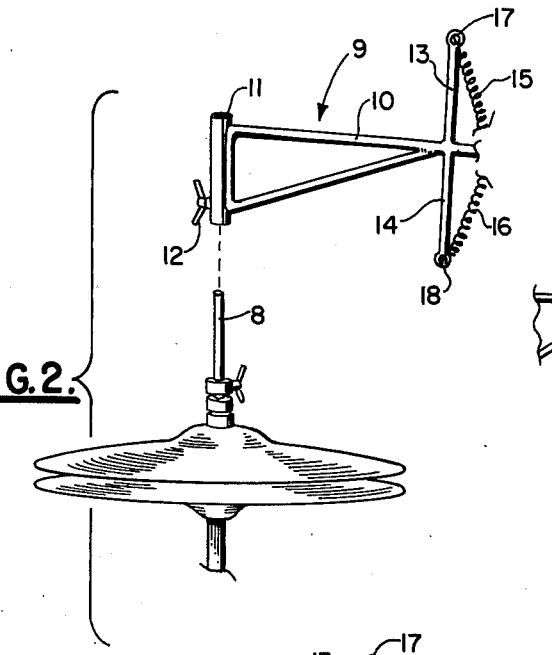
FIG. 2 is a cutaway perspective view of a preferred embodiment of the rigid arm member attachable to the conventional foot pedal drum striking device shown in FIG. 1.
Figure 3:
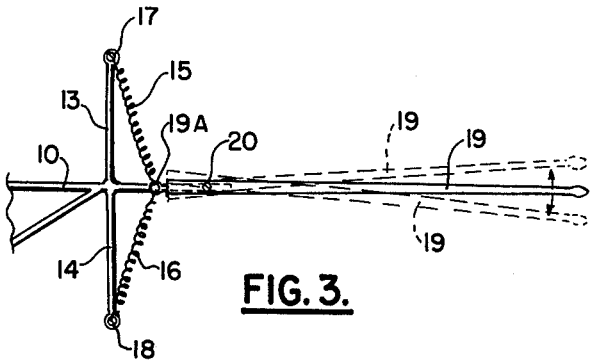
FIG. 3 is a perspective view of a preferred embodiment of the flexibly, pivoted drum stick mounted to the rigid arm member and attached to a dampening means.
Figure 1:
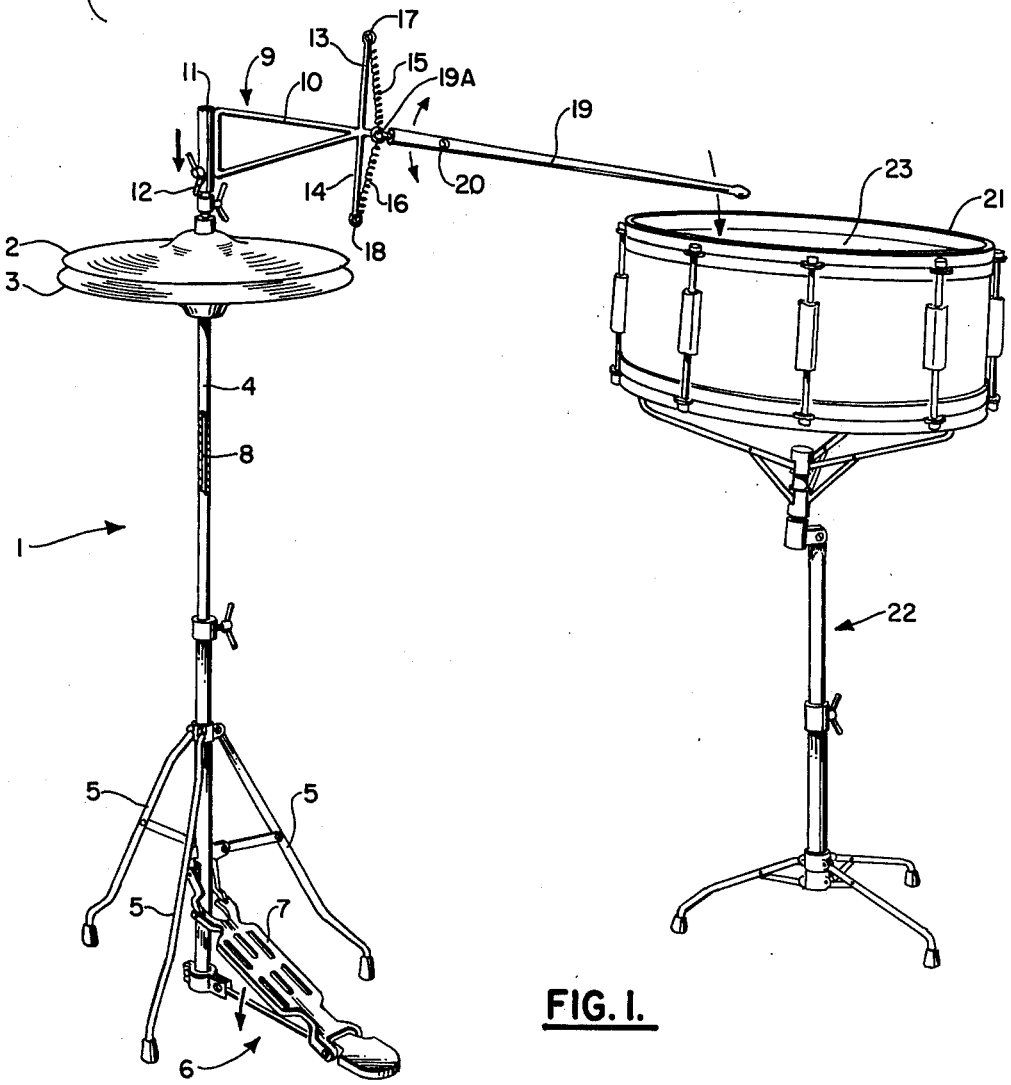
FIG. 1 is a perspective view of one embodiment of the invention attached to a conventional foot pedal drum striking device.

In FIG. 1, a conventional cymbal assembly 1 is illustrated having twin cymbals 2 and 3 supported on rod 4 and height adjustably connected to support legs 5 and operated by foot pedal assembly 6. In this conventional assembly 1, the cymbals 2 and 3 are struck together by pressing down on pedal 7 which is connected to one end of shaft 8 and which in turn is connected to cymbal 2. The downward movement of shaft 8 forces cymbal 2 into contact with cymbal 3. When pedal 7 returns to its upward position cymbal 2 is raised above and out of contact with cymbal 3.

Height adjustably attached to shaft 8 is rigid support arm 9 that has a first rod 10 extending perpendicularly outward from tubing 11 that slips over shaft 8 and is secured in position by screw 12. Fixedly attached to rod 10 are second rods 13 and 14 to which springs 15 and 16, respectively, are attached at ends 17 and 18 of second rods 13 and 14, respectively. Further outward from shaft 8, drumstick 19 is flexibly pivotedly attached by screw 20 to rod 10. End 19A of drumstick 19 attaches to both springs 15 and 16 which in a preferred feature are tension loaded to apply equal but different directional forces on drumstick 19A.

Drumstick 19 is positioned over drum 21 situated on drum stand 22 so as to strike drum surface 23 when shaft 8 is moved downward by foot pedal 7.

Because drumstick 19 is flexibly pivoted about screw 20 it strikes drum surface 23 in a natural menner. Also, springs 15 and 16 quickly dampen the oscillatory motion of drumstick 19 after it leaves drum surface 23. This allows drumstick 19 to be in position to rapidly strike drum surface 23 again.

Figure 4:
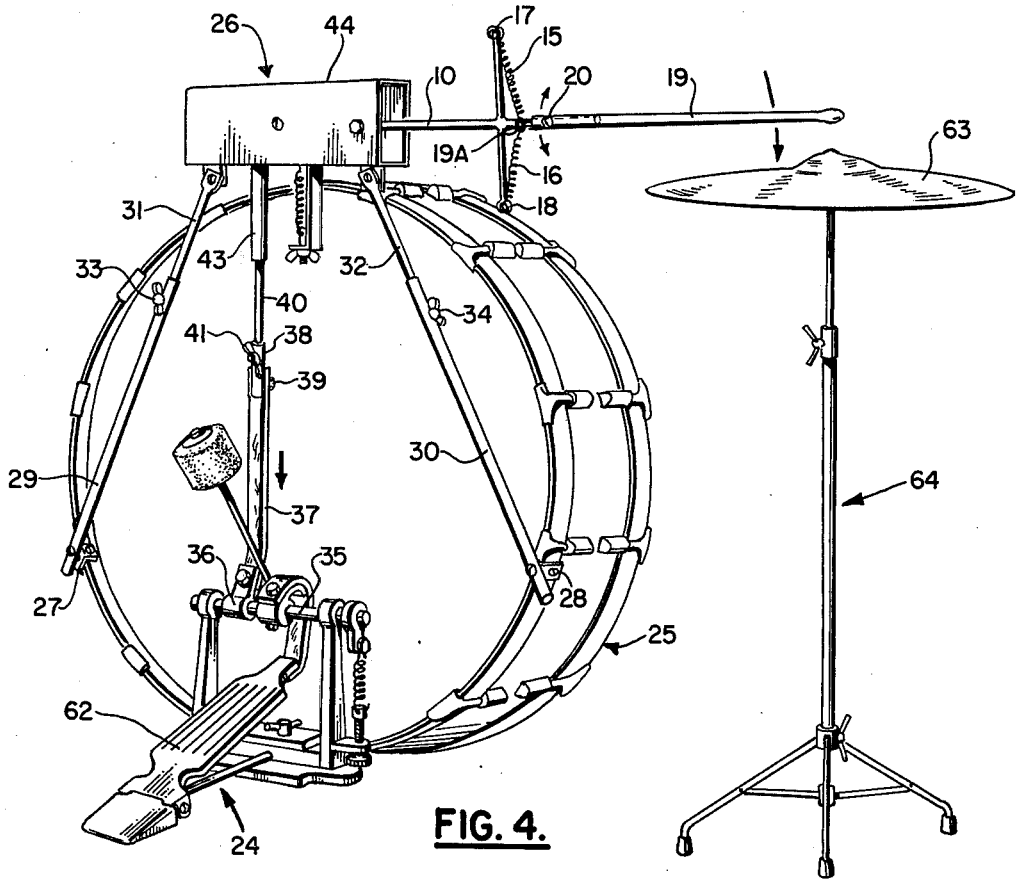
FIG. 4 is a perspective view of one embodiment of this invention attached to a conventional floor operated twin cymbal musical instrument.
Figure 5:
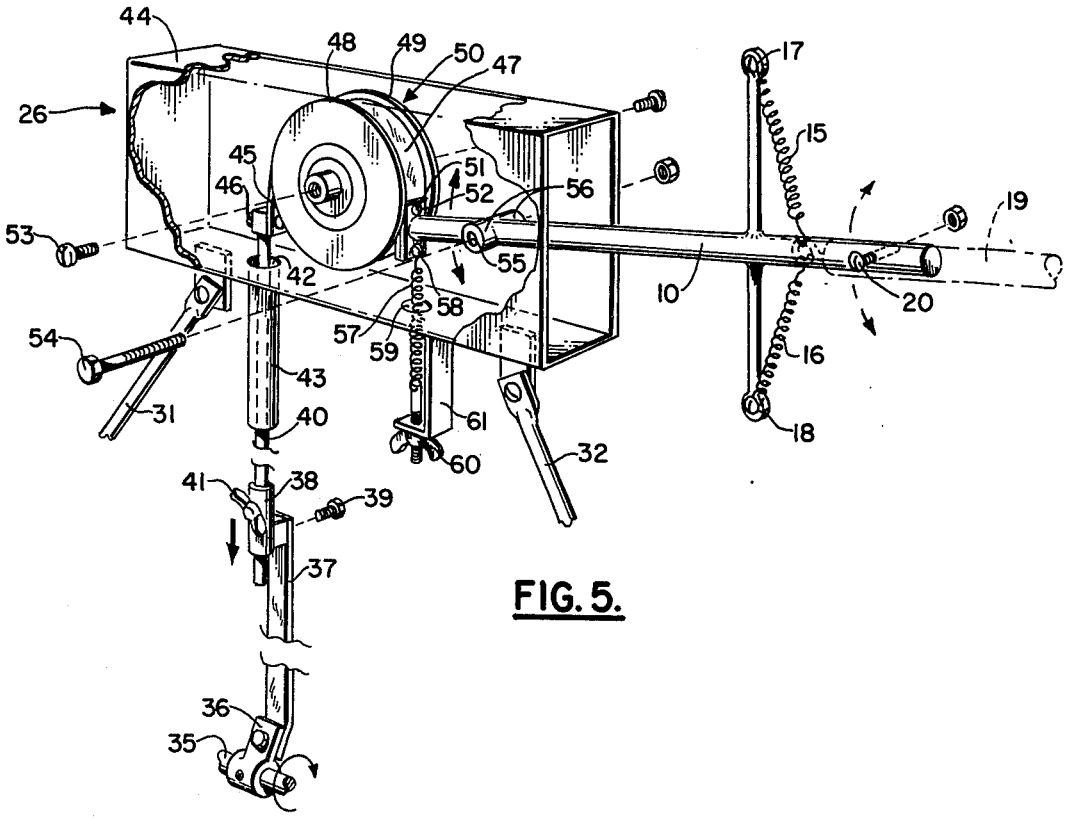
FIG. 5 is an exploded perspective view illustrating the height adjusting attachment of the rigid arm member to a conventional foot pedal operated twin cymbal musical instrument.

FIGS. 4 and 5 illustrate the use of this invention with a different type of foot pedal assembly 24 used with drum 25. In this embodiment shaft 10 is attached to foot pedal assembly 24 by shaft moving assembly 26 which connects to drum 25 in a fixed position by clamps 27 and 28 of tubing members 29 and 30 respectively. The position of shaft moving assembly 26 can be adjusted by sliding members 31 and 32 into or out of tubing member 29 and 30, respectively, and then fixing in position by tightening screws 33 and 34.

Shaft moving assembly 26 is attached to shaft 35 of foot pedal assembly by clamp 36. Leather strap 37, which is attached at one end to clamp 36 extends up tubing 38 to which it is fixedly attached by screw 39. Tubing 38 is height adjustable on tubing 40 and fixed at the desired position by wing screw 41. Tubing 40 extends upward through opening 42 of pipe extension 43 that extends perpendicularly downward by assembly casing 44. Tubing 40 is fixedly attached to a second leather strap 45 by screw 46. Leather strap 45 fits into channel 47 formed by side 48 and 49 of reel 50 and is attached to shaft end plate 52 by screws 51. In this embodiment, shaft 10 is pivoted about bolt 54 that fits through opening 55 of shaft shoulder sections 56. Shaft 10 is held in proper position by tension spring 57 that attaches to shaft end plate 52 by screw 58 and extends downward through opening 59 of casing 44 where it is attached to wing screw 60 mounted on J-frame 61 attached to casing 44.

When foot pedal 62 of foot pedal assembly 24 is pushed down shaft end plate 52 is pivoted upward about bolt 54 forcing drumstick 19 into contact with cymbal 63 which is supported on stand 64 is position below drumstick 19. Again springs 15 and 16 quickly dampen the oscillatory motion of drumstick 19 after it leaves cymbal 63 and allows for rapid repeated striking.

There are, of course, many obvious alternatives and embodiments not specifically mentioned which are intended to be included within the scope of this invention as defined in the claims below.

What I claim is:

1. A foot operated apparatus for playing a cymbal, drum or similar instrument which comprises a striking stick flexibly, pivotedly mounted on a rigid arm member attached to a foot pedal assembly that moves said arm member up and down, said rigid arm member comprising a first straight rod to which said stick is mounted parallel to said rod, second rods perpendicularly attached to said first rod and springs attached to one end of said stick said apparatus and to said second rods.

* * * * *